US010396483B2

(12) United States Patent
Lee et al.

(10) Patent No.: US 10,396,483 B2
(45) Date of Patent: Aug. 27, 2019

(54) TERMINAL AND CONNECTOR FOR CONNECTING BOARD INCLUDING THE SAME

(71) Applicants: KOREA ELECTRIC TERMINAL CO., LTD., Incheon (KR); SL Corporation, Daegu (KR)

(72) Inventors: Kyung-Nam Lee, Siheung-si (KR); Yong-Hun Lee, Daegu (KR); Choon-Woo Lee, Gyeongsan-si (KR)

(73) Assignees: KOREA ELECTRIC TERMINAL CO., LTD., Incheon (KR); SL CORPORATION, Daegu (KR)

( * ) Notice: Subject to any disclaimer, the term of this patent is extended or adjusted under 35 U.S.C. 154(b) by 0 days.

(21) Appl. No.: 15/855,552

(22) Filed: Dec. 27, 2017

(65) Prior Publication Data

US 2018/0198225 A1 Jul. 12, 2018

(30) Foreign Application Priority Data

Jan. 11, 2017 (KR) ..... 10-2017-0004236

(51) Int. Cl.

| | |
|---|---|
| ***H01R 24/00*** | (2011.01) |
| ***H01R 13/11*** | (2006.01) |
| ***H01R 12/72*** | (2011.01) |
| *H01R 4/18* | (2006.01) |

(52) U.S. Cl.
CPC ..... *H01R 13/111* (2013.01); *H01R 12/721* (2013.01); *H01R 4/185* (2013.01)

(58) Field of Classification Search
CPC .... H01R 13/111; H01R 12/721; H01R 12/72; H01R 4/18; H01R 4/185
USPC ..... 439/630, 634, 852, 856–859, 862
See application file for complete search history.

(56) References Cited

U.S. PATENT DOCUMENTS 4,070,088 A * 1/1978 Vaden ..... H01R 13/052 439/825
4,695,112 A * 9/1987 Maston ..... H01R 12/79 439/328

FOREIGN PATENT DOCUMENTS

| | | | |
|---|---|---|---|
| JP | 2003-7369 | A | 1/2003 |
| JP | 2003-7375 | A | 1/2003 |
| JP | 2016-012506 | A | 1/2016 |
| JP | 2016-051689 | A | 11/2016 |

(Continued)

OTHER PUBLICATIONS

Japanese Office Action dated Nov. 20, 2018, in connection with the Japanese Patent Application No. 2017-251559.

*Primary Examiner* — Khiem M Nguyen
(74) *Attorney, Agent, or Firm* — Hauptman Ham, LLP

(57) ABSTRACT

The present disclosure relates to a terminal capable of preventing deformation due to a load applied upon being in contact with a board, and the terminal includes a body, and a contact positioned inside the body and being in contact with the strip of the board. The contact includes a first bending portion bent backwardly from the front end of the body and elastic-deformed when being in contact with the board, a first inclined portion extending backwardly from the first bending portion, a second bending portion bent forwardly from a rear end of the first inclined portion and being in contact with the board, a second inclined portion extending forwardly from the second bending portion, and a support portion bent at a front end of the second inclined portion and limiting the deformation of the first bending portion when being in contact with the body.

16 Claims, 6 Drawing Sheets

(56) References Cited

FOREIGN PATENT DOCUMENTS

| | | | |
|---|---|---|---|
| KR | 10-1489783 | B1 | 2/2015 |
| KR | 10-2016-0027915 | A | 3/2016 |

* cited by examiner

TERMINAL AND CONNECTOR FOR CONNECTING BOARD INCLUDING THE SAME

CROSS-REFERENCE TO RELATED APPLICATIONS

This application claims the priority of Korean Patent Application No. 10-2017-0004236 filed on Jan. 11, 2017, in the Korean Intellectual Property Office, the disclosure of which is hereby incorporated by reference in its entirety.

BACKGROUND

1. Technical Field

The present disclosure relates to a terminal used in a connector for connecting a board, and more particularly, to a terminal used for electrical connection with a circuit board provided with contact strips along an edge thereof and a connector for connecting a board including the same.

2. Description of the Related Art

In general, a card edge connector is a connector used for electrical connection with a circuit board provided with contact strips along an edge thereof and is a connector capable of securing electrical reliability between a wire and a board.

A typical card edge connector is configured to accommodate a coupling edge (an edge provided with contact strips) of the circuit board and a plurality of contact pads adjacent to the coupling edge. That is, the card edge connector includes a housing provided with a slot accommodating the coupling edge of the circuit board and a plurality of terminals spaced apart from each other by a predetermined interval at one side or opposite sides of the slot. Here, the terminal includes contact parts contacting the contact strips of the circuit board, and a barrel part connected with a cable.

As illustrated in FIG. 10, when a circuit board 20 is inserted into a slot 30 of a card edge connector 1, contact parts 12 of terminals 10 installed at opposite sides of the slot 30 pressurize the circuit board 20 and are in contact with contact strips 22 provided to an edge of the circuit board 20. That is, the circuit board 20 is mechanically and electrically in contact with the terminal 10.

However, since the contact part 12 of the terminal 10 described above is spaced apart from a bottom plate 14 and has a free end shape in which an end portion of the contact part 12 is not confined, the contact part 12 may be easily deformed by external force applied downwardly to the contact part 12 (or external force applied upwardly to the contact point 12), thereby causing a contact failure, or the like.

Further, when a continuous and repeated load is applied to the terminal having the shape described above, there have been problems that elastic force and restoring force of the contact part may be deteriorated and the circuit board may not be stably in contact with the terminal when the contact part is elastic-deformed by excessive external force.

SUMMARY

It is an object of the present disclosure to provide a terminal capable of preventing deformation due to a load applied upon being in contact with a board, and capable of improving contact performance by maintaining elastic force even in a repetitive contact.

It is an object of the present disclosure to provide a connector for connecting a board capable of improving the degree of freedom of a design of a circuit and capable of preventing deformation, damage, and loss of function due to external factors.

In accordance with one aspect of the present disclosure, a terminal is a terminal which is mechanically and electrically in contact with strips provided to an edge of a board.

The terminal may include a body extending in an insertion direction of the board, a contact positioned inside the body and being in contact with the strip of the board, and a barrel formed at a rear end of the body and having a cable fixed thereto.

The contact may include a first bending portion bent backwardly from the front end of the body and elastic-deformed when being in contact with the board, a first inclined portion extending backwardly from the first bending portion, a second bending portion bent forwardly from a rear end of the first inclined portion and being in contact with the board, a second inclined portion extending forwardly from the second bending portion, and a support portion bent at a front end of the second inclined portion and limiting the deformation of the first bending portion when being in contact with the body.

A protrusion portion for a point contact with the board may be formed at a middle end of the second bending portion in a width direction of the second bending portion, and the protrusion portion may extend along the second bending portion.

In accordance with another aspect of the present disclosure, a connector for connecting a board may include a housing into which an edge of the board is inserted; and the terminal installed in the housing and being mechanically and electrically contact with a strip provided to the edge of the board.

The housing may include a board inserting portion into which the edge of the board provided with the strip is inserted, and a terminal inserting portion in which the terminal is installed, and the board inserting portion and the terminal inserting portion may be partially connected to each other.

An engaging protrusion fixing the board may be formed on an inner wall of the board inserting portion, and an engaging hole into which the engaging protrusion is inserted may be formed in the board.

Inserting grooves into which a portion of the board is inserted may be formed at opposite sides of the housing, and the inserting grooves may guide a coupling direction of the board.

DETAILED DESCRIPTION

Figure 1:
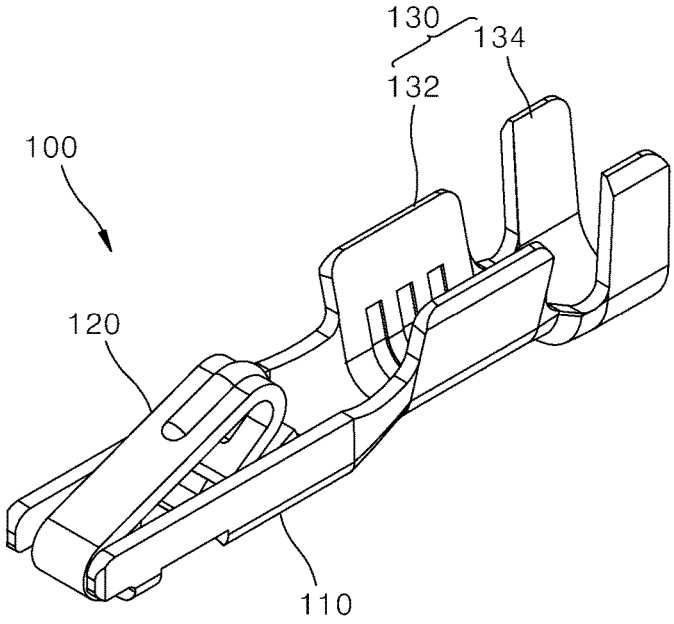
FIG. 1 is a perspective view of a terminal according to an exemplary embodiment of the present disclosure.

Hereinafter, exemplary embodiments of the present disclosure will be described in detail with reference to the accompanying drawings. Hereinafter, in describing exemplary embodiments of the present disclosure and in giving reference numerals to components of each of the accompanying drawings, the same components will be denoted by the same reference numerals even though they are shown in different drawings.

A terminal according to an exemplary embodiment of the present disclosure is a contact means which is mechanically and electrically in contact with strips provided to an edge of a board.

Figure 2:
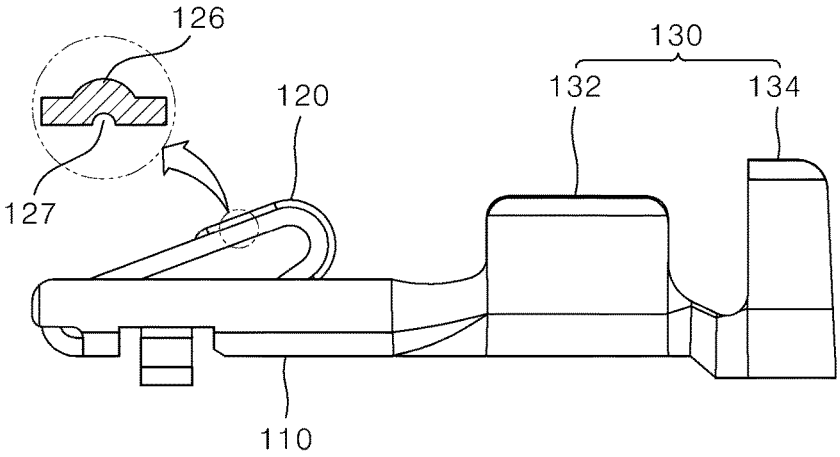
FIG. 2 is a side view of the terminal according to an exemplary embodiment of the present disclosure.
Figure 3:
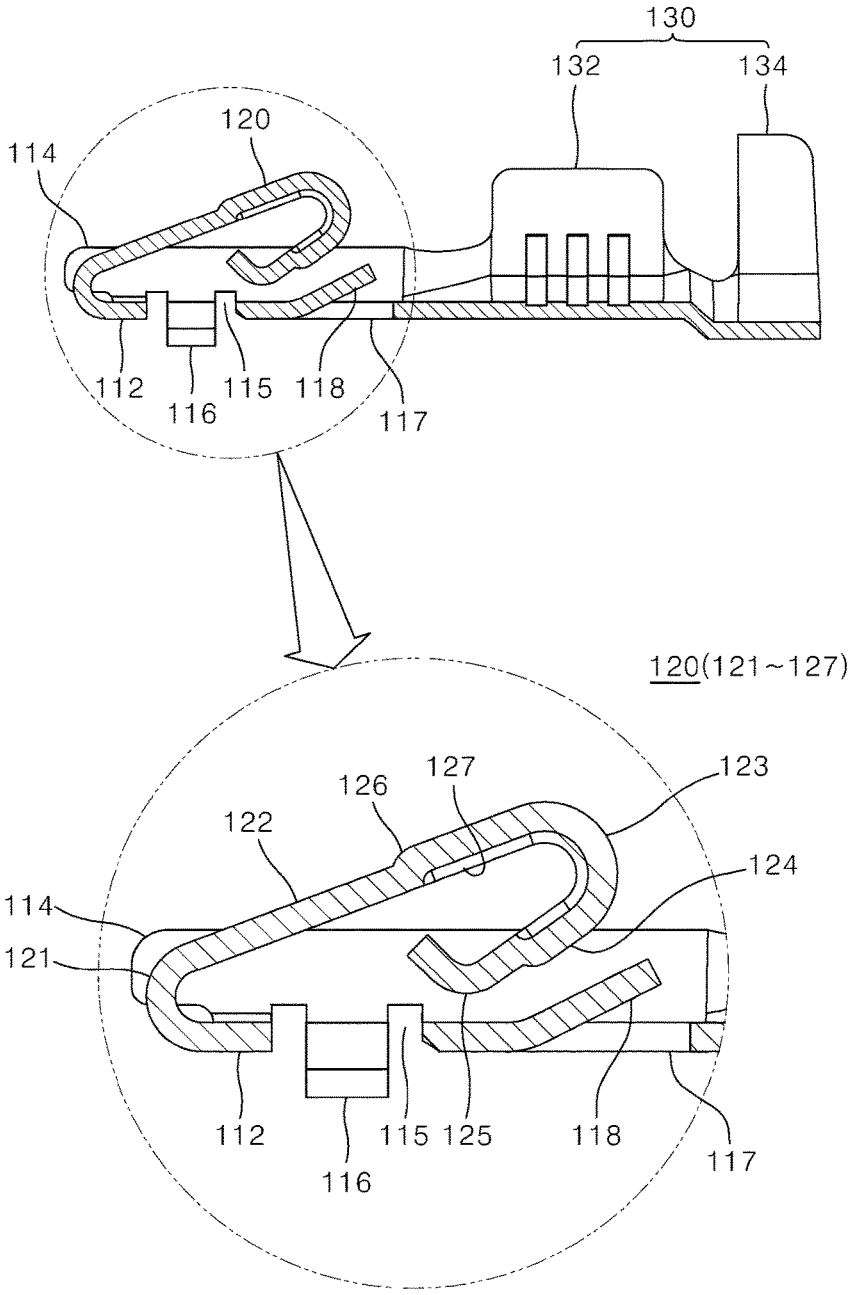
FIG. 3 is a cross-sectional view of the terminal according to an exemplary embodiment of the present disclosure.
Figure 4:
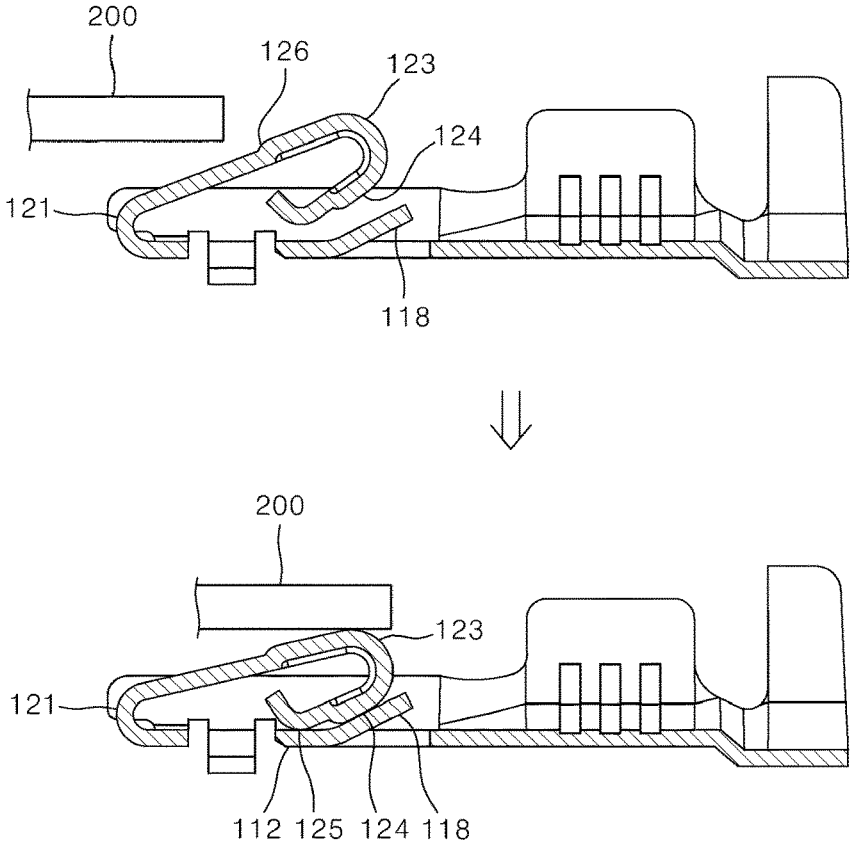
FIG. 4 and FIG. 5 are use state views of the terminal according to an exemplary embodiment of the present disclosure.
Figure 5:
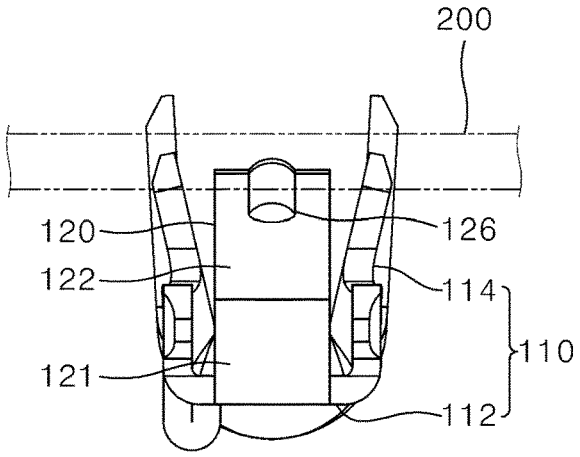
Figure 10:
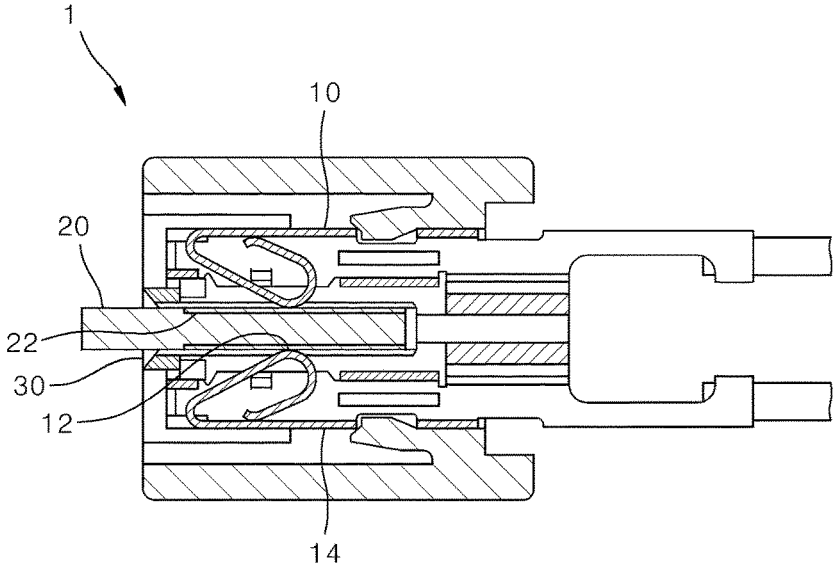
FIG. 10 is a view illustrating a card edge connector according to the related art.

As illustrated in FIG. 1, FIG. 2, and FIG. 3, a terminal 100 according to the present exemplary embodiment includes a body 110 installed in a connector (not shown) and extending in an insertion direction of a board 200 (FIG. 10), a contact 120 positioned inside the body 110 and being mechanically and electrically in contact with the board 200, and a barrel 130 formed at a rear end of the body 110 and having a cable (not shown) fixed thereto.

The terminal 100 having the configuration described above is formed of a metal material having excellent conductivity so as to transmit signals and currents applied through the board 200 to the cable, and conversely, to transmit signals and currents applied through the cable to the board 200. In particular, it is preferable that the terminal is formed of a metal material having excellent elasticity so that the contact 120 deformed upon being in contact with the board 200 may have predetermined restoring force.

The body 110 includes a bottom panel 112 extending in the insertion direction of the board 200, and side panels 114 formed at opposite sides of the bottom panel 112 and bent at right angles with the bottom panel 112. That is, the body 110 extends in the insertion direction of the board 200 and has a hexahedral shape in which a top surface thereof is opened.

A through hole 115 is formed at a front end of the bottom panel 112 and a stop piece 116 is formed at one side of the through hole 115. The through hole 115 is a portion into which a lance (not shown) is inserted when the terminal 100 is installed in the connector, and the stop piece 116 is a portion inserted into a stop groove (not shown) when the terminal 100 is installed in the connector. The through hole 115 and the stop piece 116 are means for preventing the terminal installed in the connector from moving.

A slit 117 having a shape of c is formed in a middle end of the bottom panel 112, and a support piece 118 is provided inside the slit 117. The support piece 118 serves to prevent the contact 120 from being elastic-deformed by being in contact with a second inclined portion 124 to be described below to limit deformation of a first bending portion 121, when excessive external force is applied to the contact 120 during the insertion of the board 200.

The support piece 118 has a cantilever shape connected to the bottom panel 112 and is upwardly bent to be disposed to be inclined with respect to the bottom panel 112. As such, in the case in which the support piece 118 is disposed to be inclined, a contact area with the contact 120 deformed upon inserting the board is increased, thereby making it possible to reduce a fatigue of the contact 120 and to constantly maintain contact performance.

As an example, the support piece 118 according to the present exemplary embodiment is bent to be inclined so as to be able to maintain an angle of 133° to 173° with the bottom panel 112, and the reason is because a second inclined portion 124 of the contact 120 deformed upon inserting the board 200 is inclined with respect to the bottom panel 112.

The contact 120 is formed in a shape having predetermined elasticity so as to stably support the board 200 inserted into the slot of the connector and to effectively maintain a contact with strips 210 (FIG. 10) provided to the board 200. That is, the contact 120 extends from the front end of the bottom panel 112 and is bent several times to have a shape of approximately "Z" when viewed from the side (see FIG. 3).

The contact 120 will be described in more detail with reference to FIG. 2, FIG. 3, FIG. 4 and FIG. 5.

The contract 120 includes a first bending portion 121 that is bent backwardly from the front end of the bottom panel 112. The first bending portion 121 is a portion which is elastically deformed upon being in contact with the board 200 and is bent in a shape of approximately "C" so as to be able to be restored when the board 200 is removed.

A first inclined portion 122 extends from an end portion of the first bending portion 121. The first inclined portion 122 extends backwardly from the first bending portion 121 and is disposed to be inclined at an angle of 15° to 35° with the bottom panel 112. The first inclined portion 112 inclined with respect to the bottom panel 112 allows the first bending portion 121 to be easily deformed upon inserting the board 200 and allows the board 200 to be easily inserted by minimizing insertion resistance due to the terminal 100.

A second bending portion 123 which is forwardly bent is provided to a rear end of the first inclined portion 122. The second bending portion 123 is a portion which is in contact with the strip 210 in a state in which the board 200 is inserted, and is bent in a shape corresponding to the first bending portion 121.

A second inclined portion 124 extends from an end portion of the second bending portion 123. The second inclined portion 124 extends forwardly from the second bending portion 123 and is disposed to be inclined at an angle of 5° to 30° with the first inclined portion 122.

A support portion 125 is provided to a front end of the second inclined portion 124. The support portion 125 is bent upwardly from the front end of the second inclined portion 124 and is bent at an angle of 60° to 110° with the second inclined portion 124, and an end portion of the support portion 125 is positioned to be spaced apart from the first inclined portion 122.

The second inclined portion 124 and the support portion 125 described above reduce a fatigue of the contact 120 by limiting a deformation of the first bending portion 121 when excessive external force is applied to the contact 120. In other words, upon applying the excessive external force, the second inclined portion 124 and the support portion 125 are in contact with the support piece 118 and the bottom panel 112, respectively, thereby limiting the deformation of the first bending portion 121. Further, in the state in which the second inclined portion 124 and the support portion 125 are in contact with the support piece 118 and the bottom panel 112, the second inclined portion 124 and the support portion 125 closely contact the second bending portion 123 with the strip 210 of the board 200, so that contact performance of the contact 120 may be constantly maintained.

Meanwhile, the second bending portion 123 is provided with a protrusion portion 125 for dispersing a load applied to the contact 120 to prevent the deformation. The protrusion portion 126 has a shape protruding externally and convexly from a middle end of the second bending portion 123 in a width direction of the second bending portion 123. In addition, a groove 127 of a dimple shape is formed in an inner side surface of the contact 120 on which the protrusion portion 126 is formed.

The protrusion portion 126 and the groove 127 are elongated along the second bending portion 123. In other words, the protrusion portion 126 and the groove 127 may start from a middle end of the first inclined portion 122 and extend to the middle end of the second inclined portion 124 through the second bending portion 123.

For example, a section in which the protrusion portion 126 and the groove 127 are formed in the first inclined portion 122 is about 40% of a total length and a section in which the protrusion portion 126 and the groove 127 are formed in the second inclined portion 124 is about 30% of the total length. As such, when the protrusion portion 126 and the groove 127 are formed in the section of 40% of the first inclined portion 122, an elastic restitution coefficient may be optimized, and when the protrusion portion 126 and the groove 127 are formed in the section of 30% of the second inclined portion 124, a contact position may be optimized.

It is preferable that the protrusion portion 126 described above has a height of 0.1 to 0.25 mm and a width of 0.20 to 0.35 mm If the height of the protrusion portion 126 exceeds 0.25 mm or the width thereof exceeds 0.35 mm, the load applied to the contact 120 may not be effectively dispersed, and the elastic deformation may occur due to a decrease in the strength of the second bending portion 123.

The barrel 130 is a means for mechanically and electrically connecting the cable (not shown). Such a barrel 130 includes a first compressing portion 132 compressing a wire exposed to a front end of a sheath, and a second compressing portion 134 compressing the sheath wound on the wire.

Figure 6A:
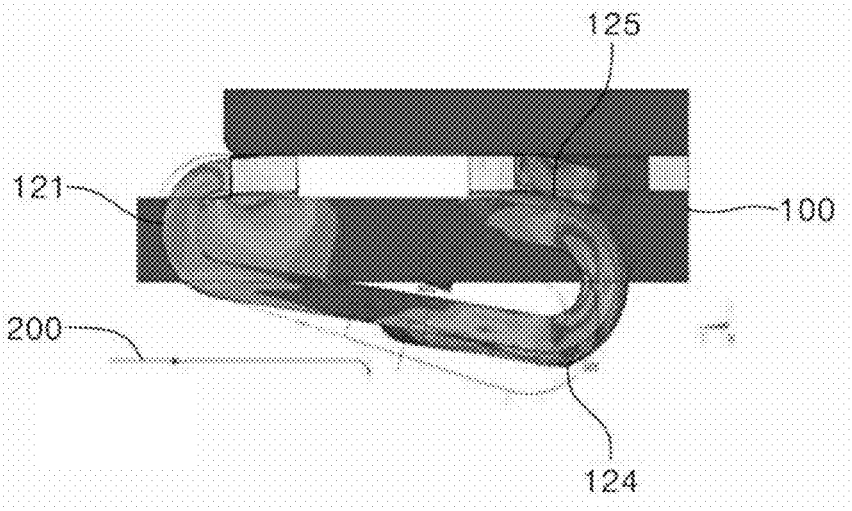
FIG. 6A and FIG. 6B is a view illustrating a stress distribution of the terminal according to an exemplary embodiment of the present disclosure.
Figure 6B:
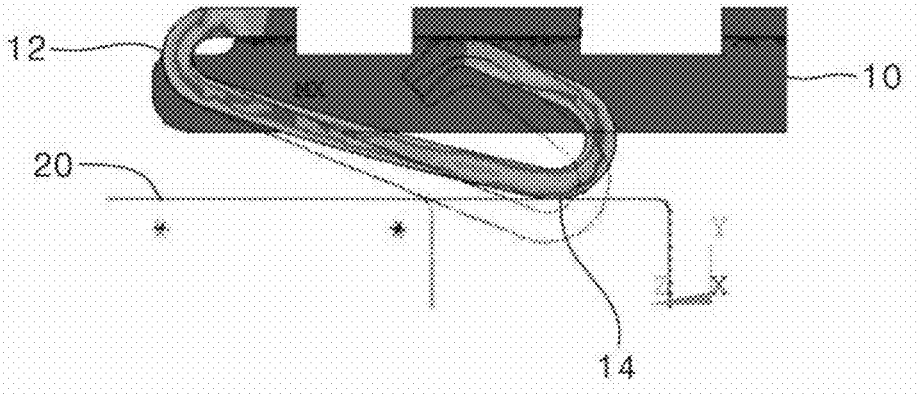

FIG. 6A illustrates a stress distribution when the terminal 100 according to the present exemplary embodiment is in contact with the board 200, and FIG. 6B illustrates a stress distribution when a typical terminal 10 is in contact with a board 20.

As illustrated in FIG. 6A, it may be seen that the load applied through the second bending portion 124 in a state in which the terminal 100 according to the present exemplary embodiment is in contact with the board 200 is dispersed to the first bending portion 121 and the support portion 125. That is, since internal stress of the contact 120 is uniformly dispersed without being concentrated on any one point, it is possible to prevent the deformation of the contact 120.

On the other hand, it may be seen that a load applied through a second bending portion 14 in a state in which the typical terminal 10 is in contact with the board 20 is concentrated on the first bending portion 12 and the second bending portion 14. Therefore, there is high possibility that problems such as the deformation and the like occur in the first bending portion 12 and the second bending portion 14 on which the load is concentrated.

Figure 7:
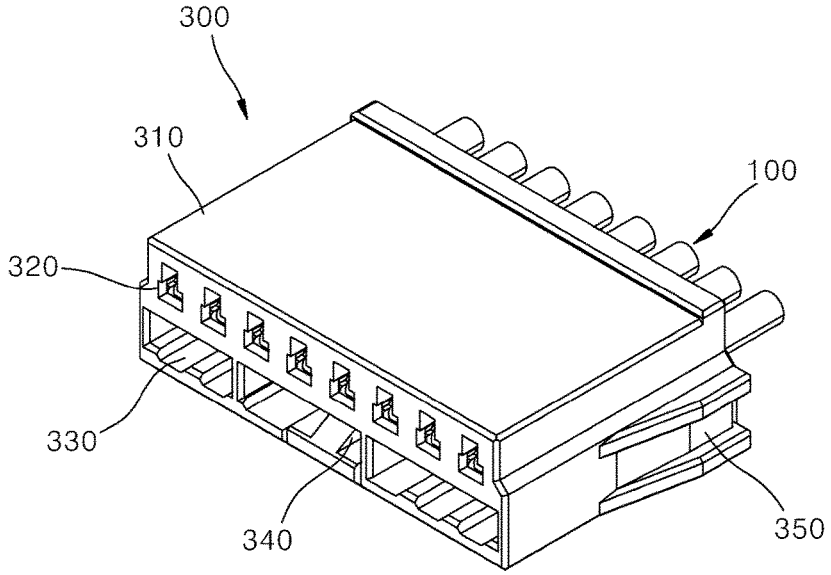
FIG. 7 is a perspective view of a connector for connecting a board including the terminal according to an exemplary embodiment of the present disclosure.
Figure 8:
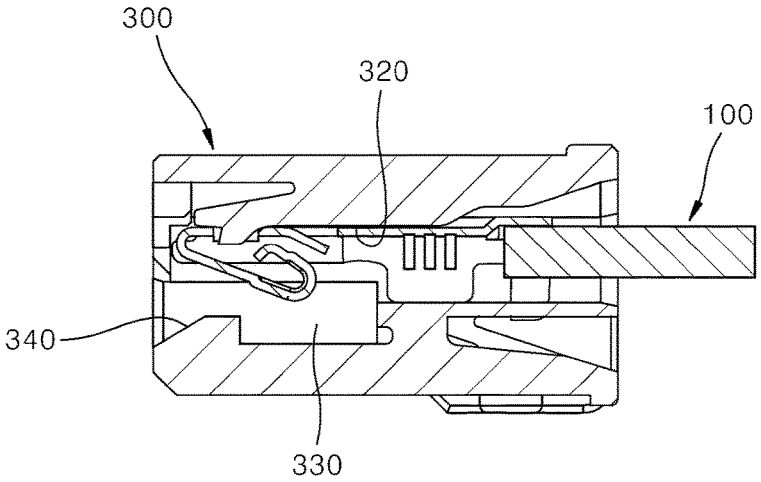
FIG. 8 is a cross-sectional view of the connector for connecting a board according to an embodiment of the present disclosure.

As illustrated in FIG. 7 and FIG. 8, a connector 300 for connecting a board including the terminal according to the present exemplary embodiment includes a housing 310, and a terminal installed in the housing 310.

The housing has a hexahedral shape into which an edge of the board 200 may be inserted. A board inserting portion 330 into which the board 200 is inserted and a terminal inserting portion 320 in which the terminal 100 is installed are formed in the housing 310.

The board inserting portion 330 is opened toward a front surface of the housing 310 so that the board 200 may be inserted, and an engaging protrusion 340 is formed in the board inserting portion 330. Further, an engaging hole 220 corresponding to the engaging protrusion is formed in the board 200 inserted into the board inserting portion 330. The engaging protrusion 340 and the engaging hole 220 prevent the board 200 inserted into the board inserting portion 330 from being arbitrarily separated.

The terminal inserting portion 320 is opened to a rear surface of the housing 310 so that the terminal 100 may be installed. The terminal inserting portion 320 is positioned above the board inserting portion 330 and is partially connected to the board inserting portion 330. This is to allow the terminal 100 inserted into the terminal inserting portion 320 to be mechanically and electrically connected to the board 200 inserted into the board inserting portion 330.

Inserting grooves 350 extending in a coupling direction of the board 200 are formed at opposite sides of the housing 310. The inserting groove 350 is a portion into which a portion of the board 200 is inserted upon installing the connector 300. Such an inserting groove 350 guides the coupling direction of the board 200 and prevents a movement between the board 200 and the connector 300 during the installation of the connector 300.

Figure 9:
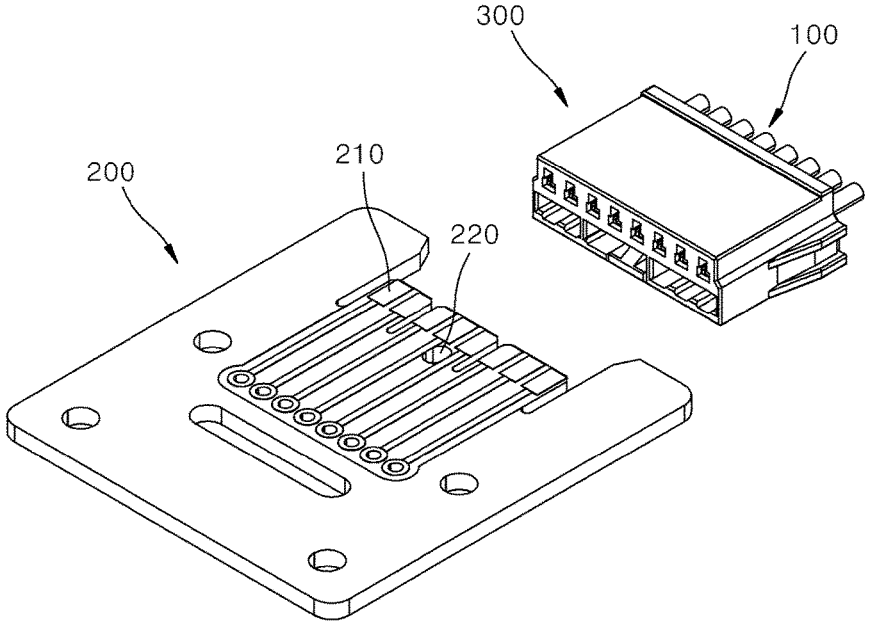
FIG. 9 is an installation state view of the connector for connecting a board according to an embodiment of the present disclosure.

As illustrated in FIG. 9, the board 200 is a plate having a thin thickness. A groove is formed in one side of the board 200 so that the connector 300 may be inserted, and strips 210 for transmitting signals and currents are formed at an inner edge of the groove.

The present exemplary embodiment illustrates that the strips 210 are formed on an upper surface of the board 200, but the strips 210 are not necessarily limited thereto, and may also be formed on a lower surface of the board 200.

As described above, according to the exemplary embodiments of the present disclosure, since the protrusion portion which is convex outwardly is formed on the second bending portion of the contact which is in contact with the board, it may effectively disperse the load applied to the contact upon being in contact with the board, thereby preventing the deformation of the terminal due to the external load. Further, since the second bending portion of the contact is in point-contact with the board through the protrusion portion, it is possible to stably maintain the contact state of the board even though the foreign materials are introduced between the board and the contact.

Further, according to the present invention, since the protrusion portion formed on the second bending portion increases rigidity of the corresponding portion, elastic force and restoring force of the terminal may be maintained from the repetitive load due to the frequent detachment of the board, thereby making it possible to improve the contact performance.

Further, according to the present invention, since the engaging protrusion for fixing the board is installed inside the housing, it is possible to improve the degree of freedom of the design of the circuit and to prevent the deformation, the damage, and the loss of function.

Hereinabove, although the exemplary embodiments of the present disclosure have been disclosed for illustrative purposes, those skilled in the art will appreciate that various modifications, additions and substitutions are possible, without departing from the scope and spirit of the disclosure as disclosed in the accompanying claims. Accordingly, the scope of the present disclosure should be construed by the following claims and it should be construed that all spirits equivalent to the following claims fall within the scope of the present disclosure.

What is claimed is:

1. A terminal which is mechanically and electrically in contact with a strip provided to an edge of a board, the terminal comprising:

a body extending in an insertion direction of the board;

a contact positioned inside the body and being in contact with the strip of the board; and a barrel formed at a rear end of the body and having a cable fixed thereto, wherein the contact is bent backwardly from a front end of the body and is elastic-deformed when being in contact with the board; and wherein the contact includes:

a first bending portion bent backwardly from the front end of the body and elastic-deformed when being in contact with the board, a first inclined portion extending backwardly from the first bending portion, a second bending portion bent forwardly from a rear end of the first inclined portion and being in contact with the board, a second inclined portion extending forwardly from the second bending portion, and a support portion bent at a front end of the second inclined portion and limiting the deformation of the first bending portion when being in contact with the body.

2. The terminal of claim 1, wherein a protrusion portion for a point contact with the board is formed at a middle end of the second bending portion in a width direction of the second bending portion, and the protrusion portion extends along the second bending portion.

3. The terminal of claim 2, wherein the protrusion portion extends from a middle end of the first inclined portion to a middle end of the second inclined portion.

4. The terminal of claim 3, wherein a groove of a dimple shape is formed at a position corresponding to the protrusion portion of an inner side surface of the contact.

5. The terminal of claim 4, wherein the protrusion portion has a height of 0.10 to 0.25 mm and a width of 0.20 to 0.35 mm.

6. The terminal of claim 5, wherein the first inclined portion is disposed at 15° to 35° with respect to the body, the second inclined portion is disposed at 5° to 30° with respect to the first inclined portion, and the support portion is disposed at 60° to 110° with respect to the second inclined portion.

7. The terminal of claim 1, wherein the body includes a bottom panel, and a pair of side panels formed at opposite sides of the bottom panel, and the contact extends from the bottom panel and is bent at the bottom panel.

8. The terminal of claim 1, wherein the bottom surface of the body is provided with a support piece which is in contact with the second inclined portion to limit a deformation of the first bending portion.

9. The terminal of claim 8, wherein the support piece is disposed at 133° to 73° with respect to the bottom panel.

10. A connector for connecting a board, the connector comprising:

a housing into which an edge of the board is inserted; and the terminal of claim 1 installed in the housing and being mechanically and electrically contact with a strip provided to the edge of the board.

11. The connector of claim 10, wherein the housing includes a board inserting portion into which the edge of the board provided with the strip is inserted, and a terminal inserting portion in which the terminal is installed, and the board inserting portion and the terminal inserting portion are partially connected to each other.

12. The connector of claim 11, wherein an engaging protrusion fixing the board is formed on an inner wall of the board inserting portion, and an engaging hole into which the engaging protrusion is inserted is formed in the board.

13. The connector of claim 12, wherein inserting grooves into which a portion of the board is inserted are formed at opposite sides of the housing, and the inserting grooves guide a coupling direction of the board.

14. A connector for connecting a board, the connector comprising:

a board in which a groove for inserting a connector is formed in one side thereof, a strip for transmitting a signal and a current is provided to an inner edge of the groove, and an engaging hole fixing the connector inserted into the groove is formed;

a housing in which a board inserting portion into which one side of the board provided with the strip is inserted and a terminal inserting portion in which a terminal which is mechanically and electrically in contact with the strip inserted into the board inserting portion is installed are formed and an engaging protrusion corresponding to the engaging hole protrudes in the board inserting portion, and formed in a hexahedral shape which is inserted into the groove; and a terminal including a body extending in an insertion direction of the board, a contact positioned inside the body, bent backwardly from a front end of the body, and elastic-deformed when being in contact with the strip, and a barrel formed at a rear end of the body and having a cable fixed thereto, wherein the contact includes:

a first bending portion bent backwardly from the front end of the body and elastic-deformed when being in contact with the board, a first inclined portion extending backwardly from the first bending portion, a second bending portion bent forwardly from a rear end of the first inclined portion and being in contact with the board, a second inclined portion extending forwardly from the second bending portion, and a support portion bent at a front end of the second inclined portion and limiting the deformation of the first bending portion when being in contact with the body.

15. The connector of claim 14, wherein inserting grooves extending in a coupling direction of the board are formed at opposite sides of the housing, and guides guiding the coupling direction of the board protrude on an upper portion and a lower portion of the inserting grooves.

16. The connector of claim 15, wherein a bottom of the inserting groove is elevated toward the coupling direction of the board and is closely in contact with both inner walls of the groove upon coupling the board.

* * * * *